US005088894A

United States Patent [19]

Patel

[11] Patent Number: 5,088,894

[45] Date of Patent: Feb. 18, 1992

[54] TURBOMACHINE BLADE FASTENING

[75] Inventor: Ashok T. Patel, Orlando, Fla.

[73] Assignee: Westinghouse Electric Corp., Pittsburgh, Pa.

[21] Appl. No.: 517,861

[22] Filed: May 2, 1990

[51] Int. Cl.[5] ..... F01D 5/30

[52] U.S. Cl. ..... 416/219 R; 416/223 A; 416/248

[58] Field of Search ..... 416/204 A, 219 R, 223 A, 416/239, 242, 248, DIG. 2, DIG. 5, 223 R

[56] References Cited

U.S. PATENT DOCUMENTS

| | | | |
|---|---|---|---|
| 1,719,415 | 7/1929 | Back | 416/219 R |
| 1,793,468 | 2/1931 | Densmore | 416/219 R |
| 2,027,745 | 1/1936 | Montgomery | 416/DIG. 2 |
| 2,709,052 | 5/1955 | Berg | 416/223 R |
| 2,848,193 | 8/1958 | Sells et al. | 416/248 X |
| 3,112,914 | 12/1963 | Wellman | 416/219 R |
| 4,650,399 | 3/1987 | Craig et al. | 416/248 X |
| 4,824,328 | 4/1989 | Pisz et al. | 416/219 R |
| 4,919,593 | 4/1990 | Brown | 416/DIG. 2 X |

FOREIGN PATENT DOCUMENTS

| | | | |
|---|---|---|---|
| 112003 | 6/1984 | European Pat. Off. | 416/193 A |

*Primary Examiner*—Edward K. Look
*Assistant Examiner*—James A. Larson

[57] ABSTRACT

Crack formation in the root portion of a turbine blade is prevented by locating the trailing edge of the air foil portion at the base section thereof in close vertical proximity to the uppermost root neck, thus minimizing trailing edge overhang which has been determined to be the cause of root tracking.

8 Claims, 5 Drawing Sheets

TURBOMACHINE BLADE FASTENING

BACKGROUND OF THE INVENTION

1. Field of the Invention

This invention relates generally to turbine blade design and, more particularly, to an improved free standing turbine blade having improved mechanical reliability.

2. Description of the Related Art

A steam turbine can include a combination of low pressure, intermediate pressure, and/or high pressure steam turbine elements which are coupled together to provide a single power output. Each steam turbine includes a rotor having a plurality of rotating blades mounted thereon in grooves. Usually, the blades of a given row are identical to each other. The rotating blades of a row extend radially outwardly from an outer surface of the rotor, with the rows being spaced apart. The rotating blades of one row differ in shape from those of the other rows; most noticeably the rotating blades of each row, or stage, vary in length depending on position along the rotor.

Each rotating blade, regardless of row, has a foil portion extending radially outwardly from the rotor and a base portion for mounting the blade to the rotor. The base portion includes a root which is fitted into a mounting groove provided for each blade of a row, and a platform integrally formed at the proximal end of the foil portion. The foil portion has a tip at the distal end and may have a twist profile from the proximal end to the distal end, or may be parallel-sided. Sometimes, shrouds are provided at the tips as separately added or integrally formed components.

A stationary cylinder is coaxially supported around the rotor and has a plurality of stationary blades mounted on an inner surface thereof. The stationary blades are arranged in rows which, when the cylinder is assembled with rotor, alternate with rows of rotating blades. The stationary blades of one row are shaped differently from those of the other rows, although all stationary blades have a foil portion. Some stationary blades have a base portion which includes a root and a platform. Other have the foil portion welded directly into blade rings with no root or platform.

The root of each stationary blade may be provided with a side notch, which when the root is fitted into the groove, aligns with an annular recess. The side notch and the annular recess together define a space which is common to both cylinder and the root. When the space is filled with caulking material, the cylinder and root become interconnected.

Rotor blade grooves provided in the rotor for mounting the rotor blades are usually geometrically more complex than the mounting grooves provided for stationary blades. Moreover, the roots of the rotating blades and the rotor are subjected to substantially greater stresses than corresponding roots of stationary blades.

Some turbines have turbine rotor blades mounted in what are referred to as "side-entry" grooves provided in the rotor. When mounted, the rotor blades extend radially outwardly from the rotor in rows which are disposed circumferentially around the rotor. Instead of having a single annular groove for mounting the plurality of rotor blades which constitute a row, a side-entry groove arrangement includes, for a given row, a series of equidistantly spaced apart side-entry grooves, each side-entry groove of the series being provided for each rotor blade of the row. Although the side-entry grooves are usually equidistantly spaced, sometime spacing is varied to facilitate assembly of a closing blade.

A typical side-entry groove starts at the outer surface of the rotor as an opening which tapers inwardly towards a bottom of the groove. A series of undulations are provided between the opening and the bottom of the groove symmetrically on opposite sidewalls of the groove. A typical root of a corresponding turbine blade has a shape which substantially conforms to that of the groove. The undulations provide a series of interlocking steps. The undulating sidewalls also make it possible to insert the root into the groove radially relative to the rotor. The resulting shape of the rotor grooves and blade root is sometimes referred to as an inverted fir tree or steeple.

In a side-entry groove, the root is pushed into the groove substantially parallel to the turbine rotor axis, and therefore, an interlocking can be achieved. Tolerances for both root and groove are very precise. A root contour tolerance envelope for contact surfaces typically varies along the contour root from one to five ten thousandths of an inch. A groove contour tolerance envelope for contact surfaces typically varies along the profile of the groove from about six to eight ten thousandths of an inch. Basically, a precise fitting between the root and the groove is required such that the maximum clearance between the root and the groove is extremely small.

There is a general reluctance to change rotor blade root and groove configurations once a particular design has been developed. This is because it may have taken months or even years of meticulous calculation to arrive at a particular design. Sometimes, slight variations in rotor blade root and groove profiles lead to unacceptable decreases in the function or performance of the blades or the rotor. Given that the tolerances between the root and the groove are critical, changes in the profile of either or both goes against conventional wisdom.

Ordinarily, the root of a side-entry rotor blade fits into the groove which has a shape nearly identical to that of the root. This is done in order to minimize losses associated with leakage of the motive fluid. An exception to this practice sometimes occurs in high-temperature applications, where clearances are introduced between the bottom of the root and the bottom of the groove to provide a passage through which a cooling medium can pass.

Fir-tree blade roots and their corresponding mounting grooves are widest at their locations nearest to the foil and the rotor body, respectively, and narrowest at the opposite ends. This is done in order to most efficiently exploit the material which is available to transmit loads from the blade to the rotor, and to provide for generous fillet radii which serve to minimize stress concentration effects.

Power generation units will over time require replacement of the blades of the turbine. Frequently, customers request that the power generation units be upgraded in terms of performance by retrofitting blades having higher performance characteristics. Present markets emphasize replacement blading on operating units to extend life, to obtain the benefits of improved thermoperformance, and to improve reliability. In addition, upgraded versions of current turbine designs with improved reliability and performance are required.

It has been observed that currently used free standing blades develop cracks in the root neck during cyclic duty operation. These root cracks are caused by repeated start-up and shut down cycle. One of the principle reasons for the development of root or steeple cracking is trailing edge "overhang" with respect to the root neck. Trailing edge overhang is illustrated in FIG. 1 as the distance A between the trailing edge 38 of a blade at the base thereof and an outline 12 of an area of the root defined by the uppermost root neck. This area is also shown in FIG. 2, which is a combination view which includes sectional and side elevational aspects. In FIG. 2, the root portion 46 and the uppermost root neck 48*a* are illustrated. FIG. 2 is a blade of slightly different configuration than FIG. 1, and illustrates a slightly more pronounced trailing edge overhang.

FIG. 3 is a stacked composite showing blade sections A—A, E—E, J—J and M—M, as well as the base section, section Q—Q which shows the relationship of the platform portion 44 to that particular section.

The various sections illustrate the contour of the blade as it progresses from the base section (Q—Q) to the tip section (A—A). Each section illustrates the basic components of the blade, which are the leading edge 36, the trailing edge 38, the convex, suction-side surface 40 and the concave, pressure-side surface 42. The root portion 46 is shown to the left-hand side of section Q—Q, for illustrative purposes as having a root center line bisecting the root portion 46 about a vertical plane of symmetry. Although the trailing edge 38 is shown in FIG. 3 to be not far from the edge of the platform portion 44, its position relative to the uppermost root neck 30 is considered critical to the present invention.

SUMMARY OF THE INVENTION

An object of the present invention is to provide an improved turbine blade design having improved thermal performance and reliability.

Another object of the present invention is to prevent cracks from forming in the root necks of the root section of a turbine blade, particularly for blades experiencing repeated start-up and shutdown cycle.

Another object of the present invention is to prevent the cracking of lashing wires provided on the airfoil portion of a turbine blade.

Yet another object of the present invention is to reduce bearing stresses which may lead to root neck cracking.

In a preferred embodiment of the present invention, a turbine blade includes an airfoil portion having a leading edge, a trailing edge, a suction-side surface, a pressure-side surface, a tip section at one end and a base section at the other, opposite end, a platform portion from which the airfoil portion extends, and a root portion extending from the platform portion in a direction opposite the airfoil portion and having a plurality of root necks including an uppermost root, wherein the trailing edge of the air foil portion at the base section is in close vertical proximity to the uppermost root neck to minimize trailing edge overhang.

In another aspect of the present invention, a method of preventing cracks from forming in a root portion of a turbine blade includes placing a trailing edge of an airfoil portion at a base section thereof in close vertical proximity to an uppermost root neck of the root portion, thereby minimizing trailing edge overhang.

These and other features and advantages of the improved turbine blade design according to the present invention will become more apparent with reference to the following detailed description and drawings.

DETAILED DESCRIPTION OF THE PREFERRED EMBODIMENTS

Figure 6:
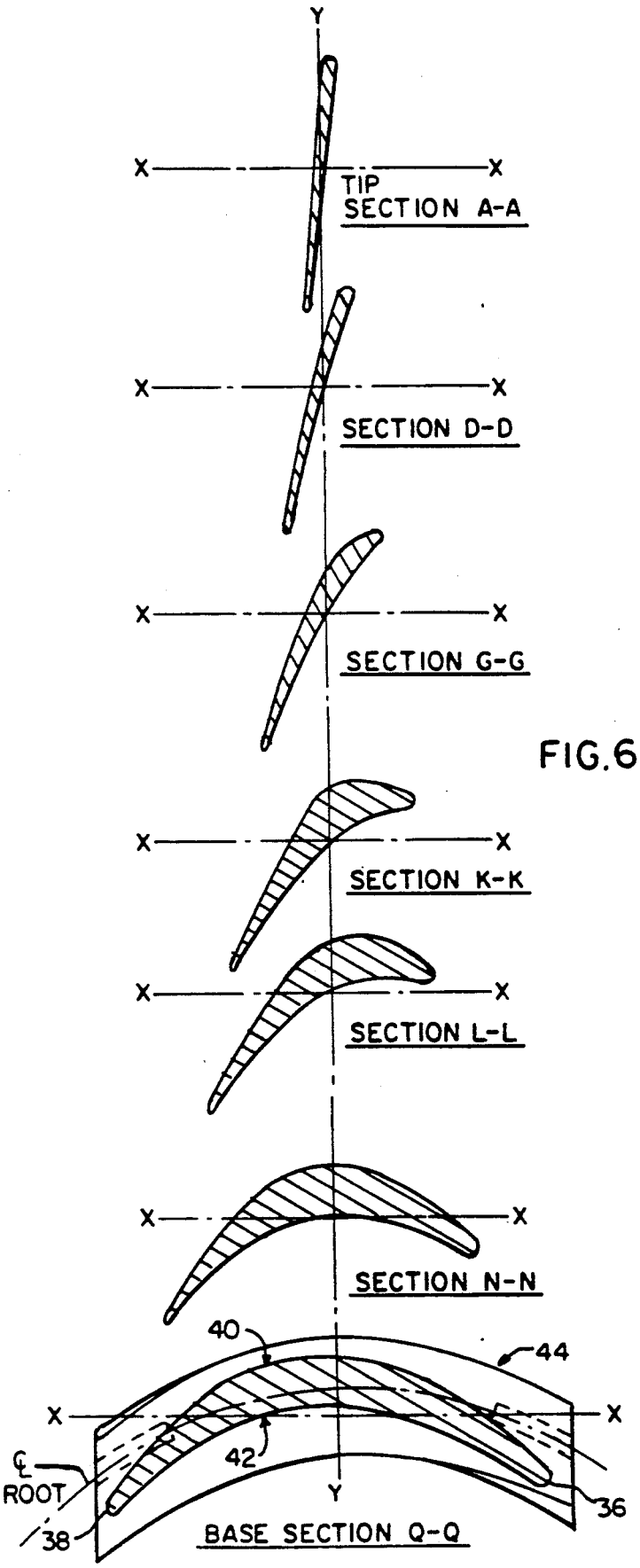
FIG. 6 is a sectional view of the turbine blade of FIG. 4.
Figure 7:
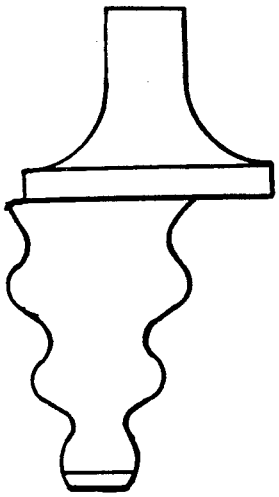
FIG. 7 is an end view of the root portion (viewed from the left side of FIG. 6)
Figure 8:
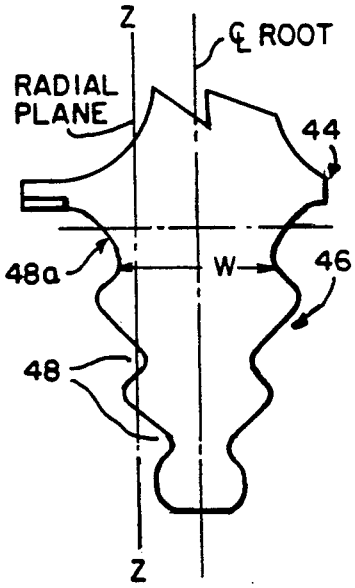
FIG. 8 is a sectional view taken along line VIII—VIII of FIG. 4.

Referring now to FIGS. 4 through 9, a turbine blade 32 of the present invention includes an air foil portion 34 having a leading edge 36, a trailing edge 38, a suction side surface 40, a pressure-side surface 42, a tip section A—A and a base section Q—Q. Various other sections D—D, G—G, K—K, L—L and N—N are illustrated in FIG. 6 to describe the shape of the air foil portion 34 as it progresses in the radial direction.

A platform portion 44 provides a base from which the air foil portion 34 extends. A root portion 46 extends from the platform portion 44 in a direction opposite the air foil portion 34 and has a plurality of root necks 48, including uppermost root neck 48*a*. The opposite sides of the root necks define the width of the root necks. For example, in FIG. 8 the uppermost root neck 48*a* has a width W as the shortest straight line distance between the inner most points of the root neck fillets. This straight line is perpendicular to the root center line.

Figure 1:
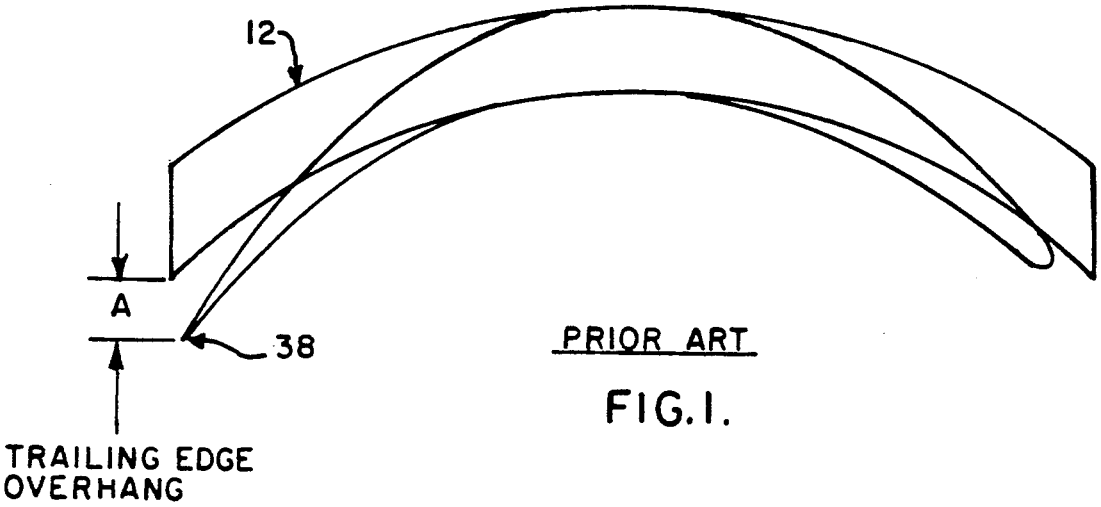
PRIOR ART FIG. 1.
FIG. 1 is a base sectional view of a known turbine blade, showing trailing edge overhang.
Figure 2:
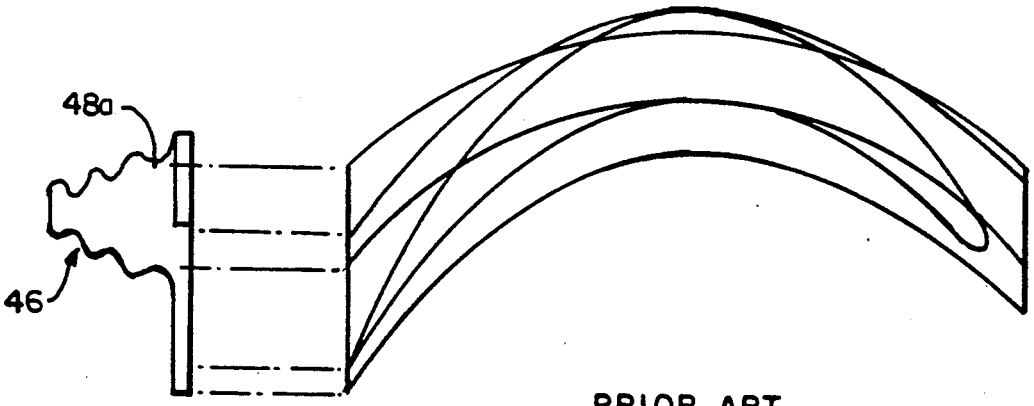
PRIOR ART FIG. 2.
FIG. 2 is a base sectional view of another known turbine blade, also showing an end view of a root portion thereof.
Figure 9:
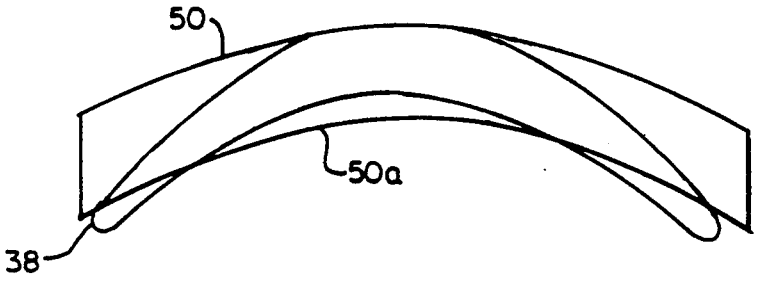
FIG. 9 is a base sectional view showing the relative positions of the trailing edge of the blade of FIG. 4 and the root neck region.

As shown in FIG. 9, the uppermost root neck defines an arcuate area 50, the arcuate sides of which are defined by the apex of the curve forming each side of the neck, whereas the linear sides of the arcuate area 50 are defined by the end faces of the root 46. The trailing edge 38 of the air foil portion at the base section Q—Q is critically located in close, vertical proximity to the uppermost root neck 48*a* to minimize trailing edge overhang. In particular, the trailing edge 38 overlies the arcuate side 50*a* of the arcuate area 50, as shown in FIG. 9. FIG. 9 contrasts to FIGS. 1 and 2, in which the trailing edge extends beyond the arcuate side of the area 12.

The turbine blade illustrated in FIGS. 4 through 9 has a 32 inch (812.8 mm) air foil portion, and was designed to replace an existing 28.5 inch (723.9 mm) lashed blade. The blade according to the present invention is free standing, i.e., non-lashed, and is carried by a root which is wider than any other blade of similar design. The uppermost root neck width is about 1.56 inches (39.624 mm). The large root size of the blade reduces bearing stress to prevent cracking. Also, the extended length, angle and geometry significantly improve thermodynamic performance.

Figure 3:
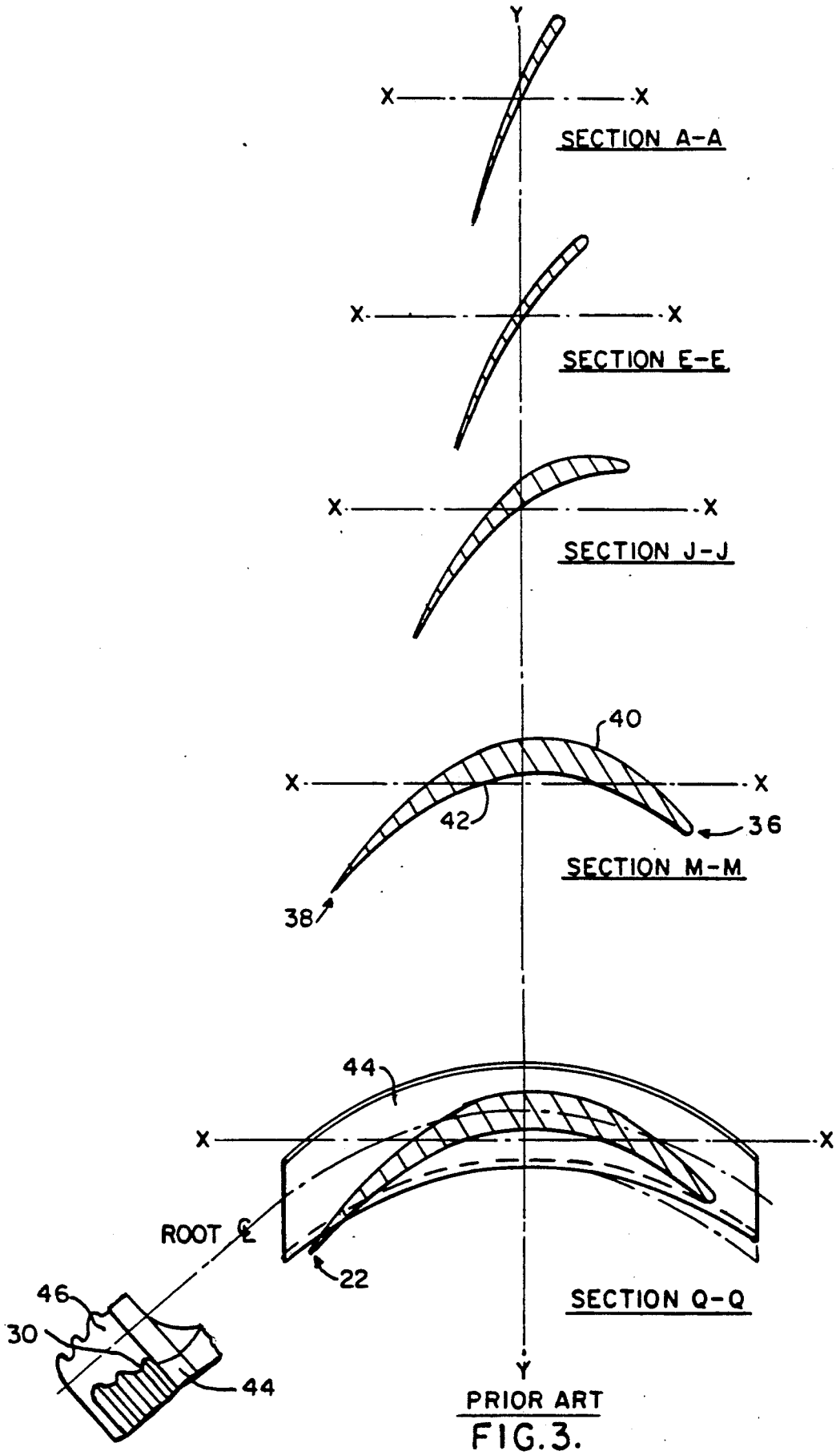
PRIOR ART FIG. 3.
FIG. 3 is a stacked, sectional view showing various sections of a known turbine blade, along with an end view of a root portion thereof.
Figure 4:
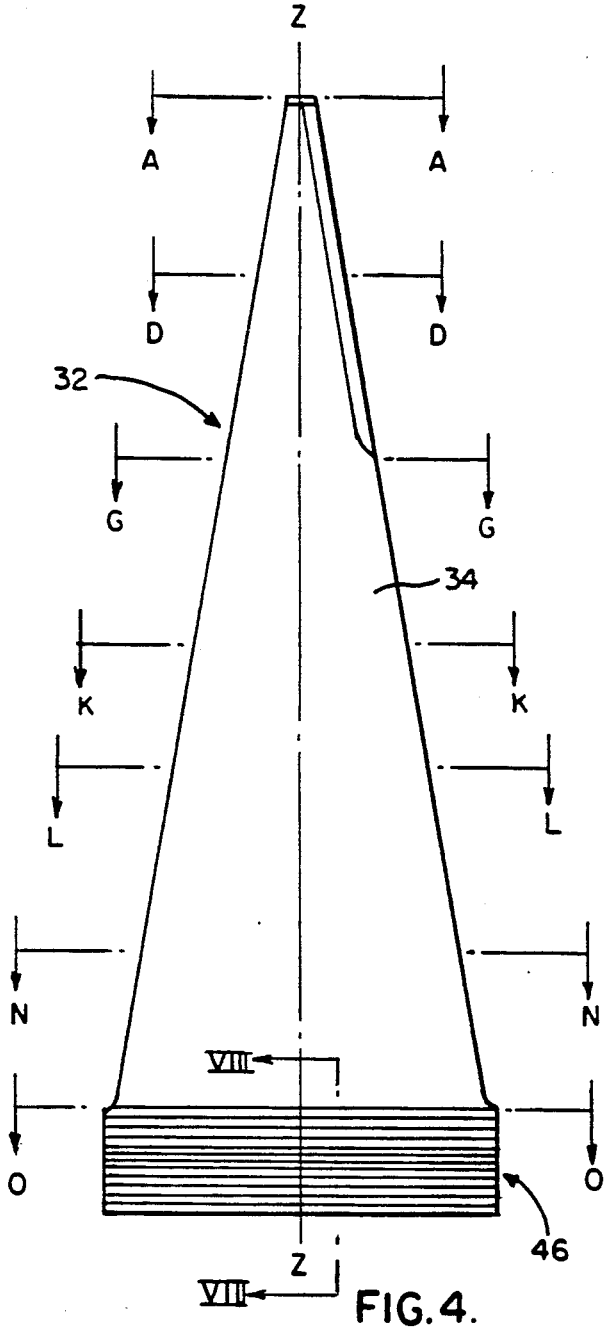
FIG. 4 is a side elevational view of a turbine blade and root portion thereof according to the present invention.
Figure 5:
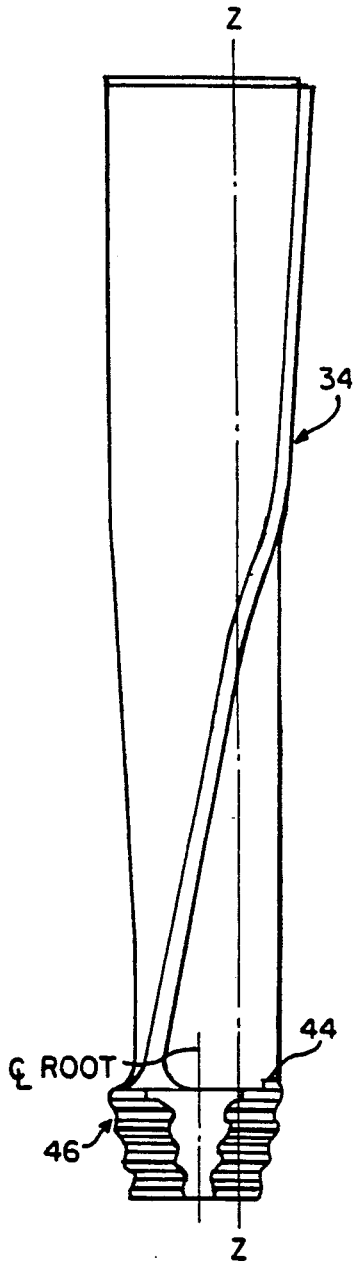
FIG. 5 is an end view of the turbine blade of FIG. 4.

Mechanical reliability of the blade is improved such that the blade sections are designed so that the calculated strength for all untuned modes of vibration is higher than its predecessor blade, which is illustrated in FIG. 3. Moreover, since the blade is carried by the widest and deepest root, which increases land bearing surface, bearing stresses are thereby reduced. High bearing stresses during cyclic operation damage the bearing surfaces and lead to crack initiation.

Since the blade is about 3.545 inches (90.043 mm) longer than the existing 28.5 inch lashed blade, there will be a decrease in leaving loss and a concomitant increase in blade performance.

Another feature of the present invention is illustrated in FIG. 6, in which the various sections of the blade have flat or straight back contours, meaning that from the trailing edge 38 and extending along the suction-side surface 40, the surface is relatively flat up to the x-coordinate. This straight-back geometry reduces flow losses during transonic flow operation, thus improving upon the original, curved-back design.

Figure 10:
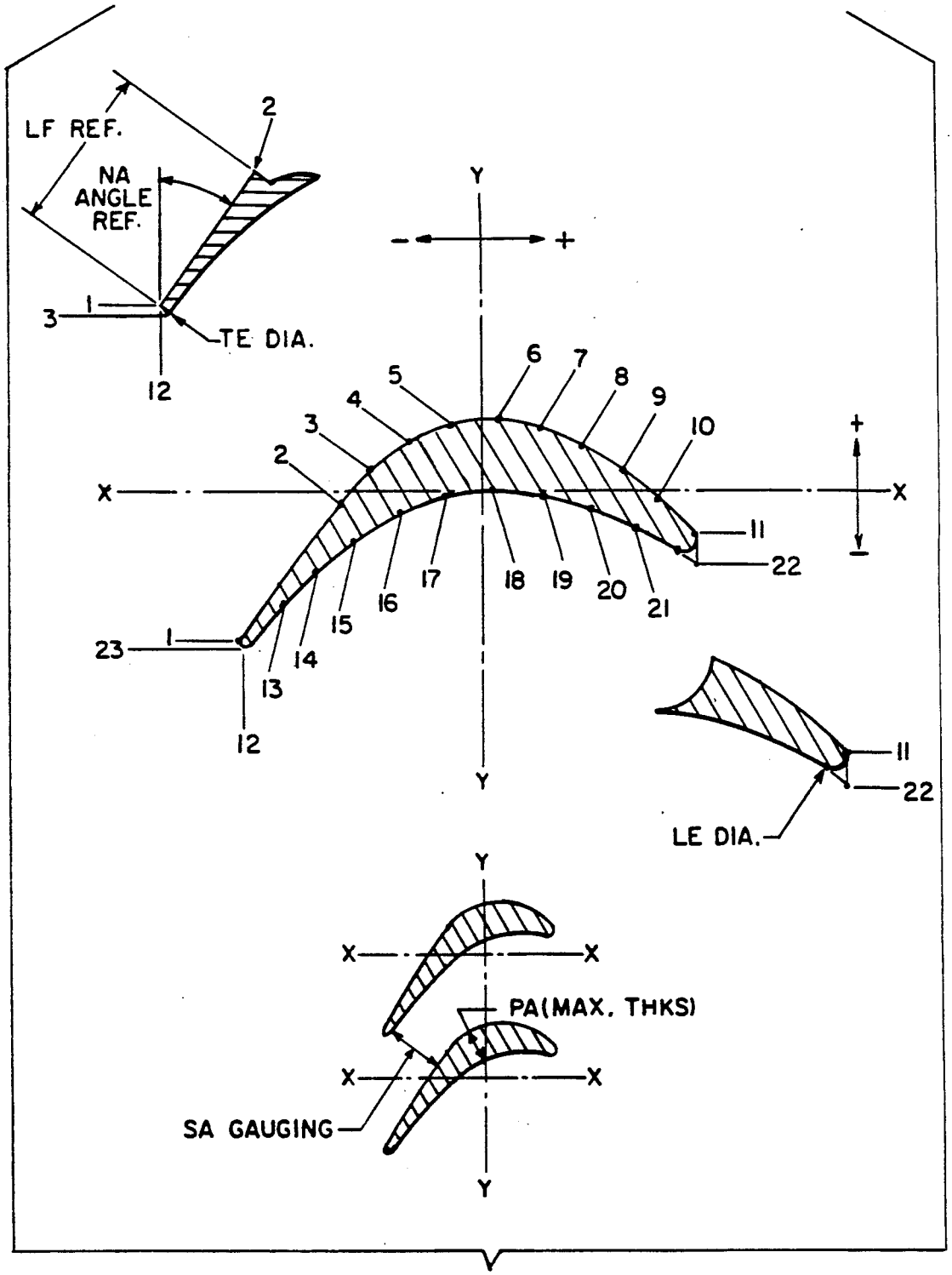
FIG. 10 is a reference schedule showing points of reference of a typical section of the turbine blade of FIG. 4.

FIG. 10 is a reference schedule showing points of reference for a typical section of the air foil portion of the turbine blade of the present invention. The numbered reference points indicate points along the suction-side and pressure-side surface, as well as points relative to the leading edge and trailing edge. The reference point 2 indicates the end of a flat part of the suction-side surfaces relative to reference point 1, which is the beginning of the flat part at the trailing edge. The distance "L-F REF" refers to the length of the flat part between reference points 1 and 2. This length is shown to increase constantly from the base section to the tip section in the following chart.

The "NA ANGLE REF" refers to the angle between the flat part of the suction-side surface and a straight vertical line drawn tangentially to the trailing edge and parallel to the Y-axis. The values for the NA angle are shown to decrease constantly from the base section to the tip section, with the tip section having a very slight angle of about 40.

The reference PA(MAX THKS) refers to the maximum thickness of each blade section. It can be seen from the chart that the maximum thickness increases from the base section to the next adjacent section, but then decreases from that section to the tip section.

The reference TE DIA. and LE DIA. refer to trailing edge diameter and leading edge diameter, respectively. It can be seen from the chart that the trailing edge thickness decrease from the base section to the tip section. The same applies for the leading edge diameter.

SA gauging is shown to increase from the base section to the L—L section, and then decrease from the L—L section to the tip section.

| SECT. | SA GAUGING (mm) | ANGLE (REF) | PA MAX. THKS. (mm) | TE DIA. (mm) | LE DIA. (mm) | END O FLAT PT. NO. | LF (REF) (mm) |
|---|---|---|---|---|---|---|---|
| A-A | 12.192 | 4°00'57" | 8.6106 | 3.0226 | 8.382 | 2 | 155.676 |
| D-D | 31.496 | 12°05'58" | 11.4554 | 3.4544 | 8.9662 | 2 | 136.9822 |
| G-G | 44.2468 | 19°39'15" | 18.923 | 4.1 02 | 9.7282 | 2 | 125.1966 |
| K-K | 50.3174 | 26°09'05" | 29.1084 | 4.9784 | 11.2776 | 2 | 110.236 |
| L-L | 54.6354 | 31°47'00" | 31.6992 | 5.4356 | 18.8214 | 2 | 95.25 |
| N-N | 50.7746 | 35°39'52" | 34.0868 | 6.0706 | 13.6398 | 2 | 78.1558 |
| Q-Q | 44.0182 | 43°38'54" | 33.7058 | 12.5222 | 15.0368 | 2 | 59.309 |

Numerous modifications and adaptations of the present invention will be apparent to those so skilled in the art and thus, it is intended by the following claims to cover all such modifications and adaptations which fall within the true spirit and scope of the invention.

What is claimed is:

1. A turbine blade comprising:

an air foil portion having a leading edge, a trailing edge, a convex suction-side surface, a concave pressure-side surface, a tip section at one end, and a base section at the other, opposite end;

a platform portion from which the air foil portion extends and having a convex side and a concave side;

a root portion having a convex side, a concave side, a root center line and extending from the platform portion in a direction opposite the air foil portion and having a plurality of root necks including an uppermost root neck, each root neck having symmetrically formed opposite surfaces extending radially inwardly towards the root center line and having a width corresponding to the horizontal straight line distance between two parallel arcuate lines defined by radially innermost points on the opposite surfaces, wherein, at a plane section where the air foil portion meets the platform portion, the trailing edge of the air foil portion is in close proximity to the arcuate line of the uppermost root neck on the concave side of the root portion to minimize trailing edge overhang and wherein the airfoil portion is free standing and has a length of 32 inches, and the uppermost root neck width is about 1.56 inches.

2. A turbine blade as recited in claim 1, wherein the trailing edge overlies the uppermost root neck.

3. A turbine blade as recited in claim 1, wherein the leading edge has a diameter which decreases from the base section to the tip section.

4. A turbine blade as recited in claim 1, wherein the suction-side surface of the air foil portion has a flat-back portion extending from the trailing edge.

5. A turbine blade as recited in claim 4, wherein the flat back portion has a length which increases from the base section to the tip section.

6. A turbine blade as recited in claim 5, wherein the flat back portion is angled relative to vertical, and the degree of angle decreases from the base section to the tip section.

7. A turbine blade as recited in claim 6, wherein the tip section angle of the flat back portion is about 40.

8. A turbine blade as recited in claim 1, wherein the trailing edge has a width which decreases from the base section to the tip section.

* * * * *